US006707429B1

(12) United States Patent
Siegel

(10) Patent No.: US 6,707,429 B1
(45) Date of Patent: Mar. 16, 2004

(54) SELF-CONTAINED SUB-MILLIMETER WAVE RECTIFYING ANTENNA INTEGRATED CIRCUIT

(75) Inventor: Peter H. Siegel, La Canada, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/318,670

(22) Filed: Dec. 9, 2002

(51) Int. Cl.[7] ..... H01Q 1/12

(52) U.S. Cl. ..... 343/700 MS; 343/770; 343/795

(58) Field of Search ..... 343/700 MS, 767, 343/770, 795, 829, 846; 437/203, 906; H01Q 1/12

(56) References Cited

U.S. PATENT DOCUMENTS 3,944,950 A * 3/1976 Jacobs et al. ..... 333/164
4,751,513 A * 6/1988 Daryoush et al. .... 343/700 MS
4,980,615 A * 12/1990 Pentchev et al. ..... 315/382
5,155,050 A * 10/1992 Bayraktaroglu ..... 438/380

* cited by examiner

*Primary Examiner*—Tho G. Phan
(74) *Attorney, Agent, or Firm*—John H. Kusmiss

(57) ABSTRACT

The invention is embodied in a monolithic semiconductor integrated circuit in which is formed an antenna, such as a slot dipole antenna, connected across a rectifying diode. In the preferred embodiment, the antenna is tuned to received an electromagnetic wave of about 2500 GHz so that the device is on the order of a wavelength in size, or about 200 microns across and 30 microns thick. This size is ideal for mounting on a microdevice such as a microrobot for example. The antenna is endowed with high gain in the direction of the incident radiation by providing a quarter-wavelength (30 microns) thick resonant cavity below the antenna, the cavity being formed as part of the monolithic integrated circuit. Preferably, the integrated circuit consists of a thin gallium arsenide membrane overlying the resonant cavity and supporting an epitaxial Gallium Arsenide semiconductor layer. The rectifying diode is a Schottky diode formed in the GaAs semiconductor layer and having an area that is a very small fraction of the wavelength of the 2500 GHz incident radiation. The cavity provides high forward gain in the antenna and isolation from surrounding structure.

37 Claims, 8 Drawing Sheets

SELF-CONTAINED SUB-MILLIMETER WAVE RECTIFYING ANTENNA INTEGRATED CIRCUIT

ORIGIN OF THE INVENTION

The invention described herein was made in the performance of work under a NASA contract, and is subject to the provisions of Public Law 96-517 (35 U.S.C. §202) in which the Contractor has elected not to retain title.

BACKGROUND OF THE INVENTION

The invention is related to power supplies for deployable Microsystems such as TeraHertz sensors, bioengineering nanodevices, micro-robots, nanofabrication and planar antennas. Supplying electrical power to micro-devices from a battery or from wires is often impractical because the weight of the wires or battery may impair the performance of the microdevice being powered. The present invention provides electrical power from electromagnetic radiation incident on a local antenna mounted on the microdevice to be powered. One problem with such an arrangement is that the antenna performance is affected by the electrical characteristics of the microdevice on which it is mounted. Thus, the design of the underlying microdevice is constrained so as to avoid detracting greatly from antenna performance, which is inconvenient. Another problem is that an antenna sufficiently small to fit on a microdevice, such as a micro-miniature dipole antenna, will typically have poor gain in the direction of the radiation because such an antenna will have little directionality. A further problem is that a diode must be employed to rectify the received RF power. The impedance of the diode will not necessarily match the impedance of the antenna, depending upon the frequency of the incident radiation, so that some power will be lost. Yet another problem is to find a radiation frequency at which the ideal antenna size is small compared to the microdevice on which it is to be mounted, but not so small that the frequency reaches the optical range in which a diode rather than an antenna must be used. This would sacrifice the advantage of tunability of an antenna. Further, it would be desirable if the radiation frequency were one that readily penetrated certain materials such as plastic, human skin (for bio-engineering applications) and the like.

SUMMARY OF THE DISCLOSURE

The invention is embodied in a monolithic semiconductor integrated circuit in which is formed an antenna, such as a slot dipole antenna, connected across a rectifying diode. In the preferred embodiment, the antenna is tuned to received an electromagnetic wave of about 2500 GHz so that the device is on the order of a wavelength in size, or about 200 microns across and 30 microns thick. This size is ideal for mounting on a microdevice such as a microrobot for example. The antenna is endowed with high gain in the direction of the incident radiation by providing a quarter-wavelength (30 microns) thick resonant cavity below the antenna, the cavity being formed as part of the monolithic integrated circuit. Preferably, the integrated circuit consists of a thin silicon membrane overlying the resonant cavity and supporting an epitaxial Gallium Arsenide semiconductor layer. The rectifying diode is a Schottky diode formed in the GaAs semiconductor layer and having an area that is a very small fraction of the wavelength of the 2500 GHz incident radiation. Preferably, the antenna is a pair of half-wavelength dipole slots in the overlying conductor layer that forms respective power output terminals and respective tuning capacitors across the rectifying diode. At the 2500 GHz frequency, the pair of half-wavelength dipoles exhibit an impedance that nearly matches the impedance of the Schottky rectifying diode, a significant advantage. A most significant advantage is provided by the combination in the integrated circuit of the antenna with the quarter wavelength resonant cavity, because the antenna behavior is determined principally by the resonant cavity. The resonant cavity both provides the directional gain of the antenna and isolates the antenna from surrounding structure. In this way, the integrated circuit may be mounted on any structure without appreciably affecting the antenna behavior.

DETAILED DESCRIPTION

Figure 1:
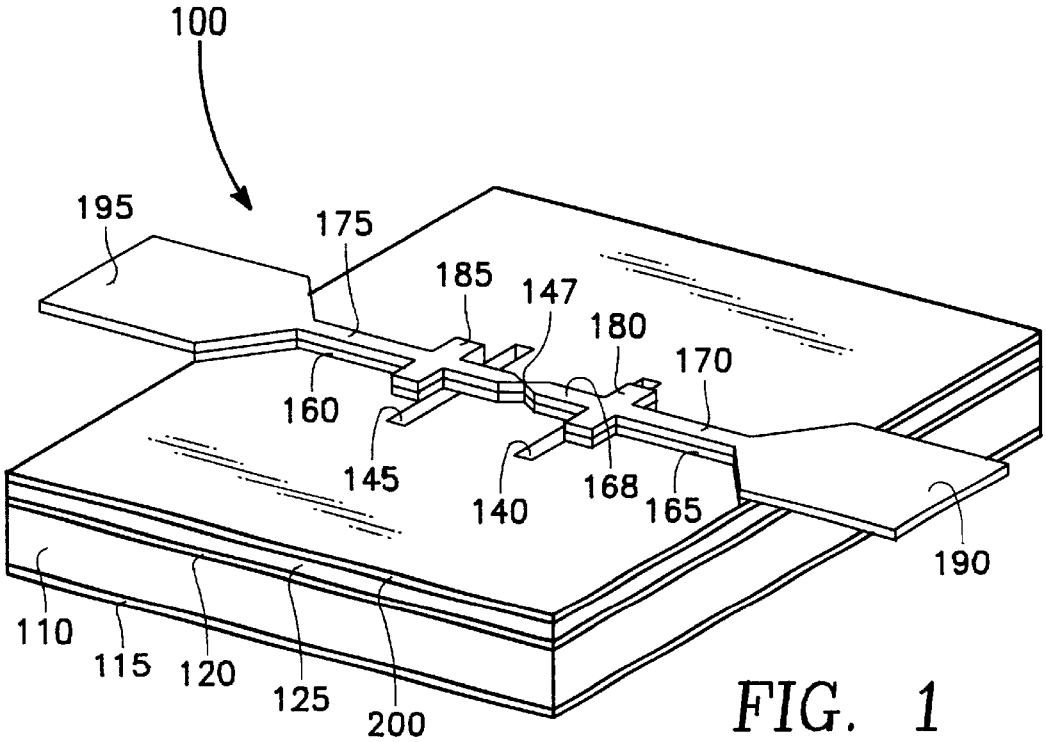
FIG. 1 is a top perspective view of an integrated circuit embodying the present invention.
Figure 2:
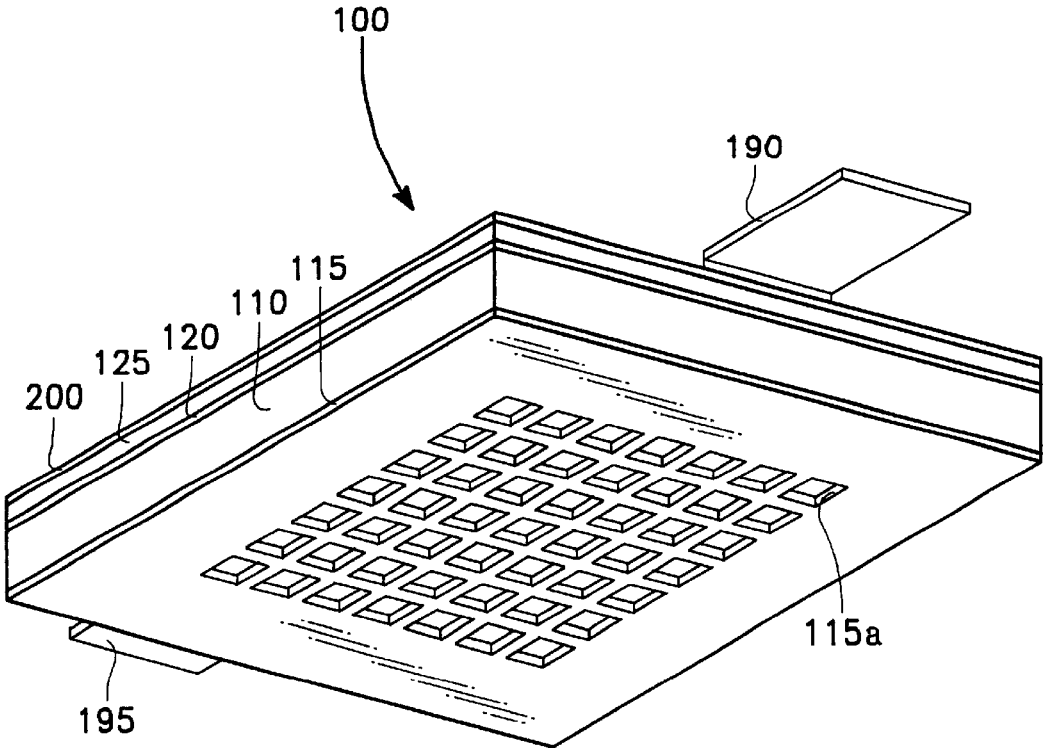
FIG. 2 is a bottom perspective view of the integrated circuit of FIG. 1.
Figure 3:
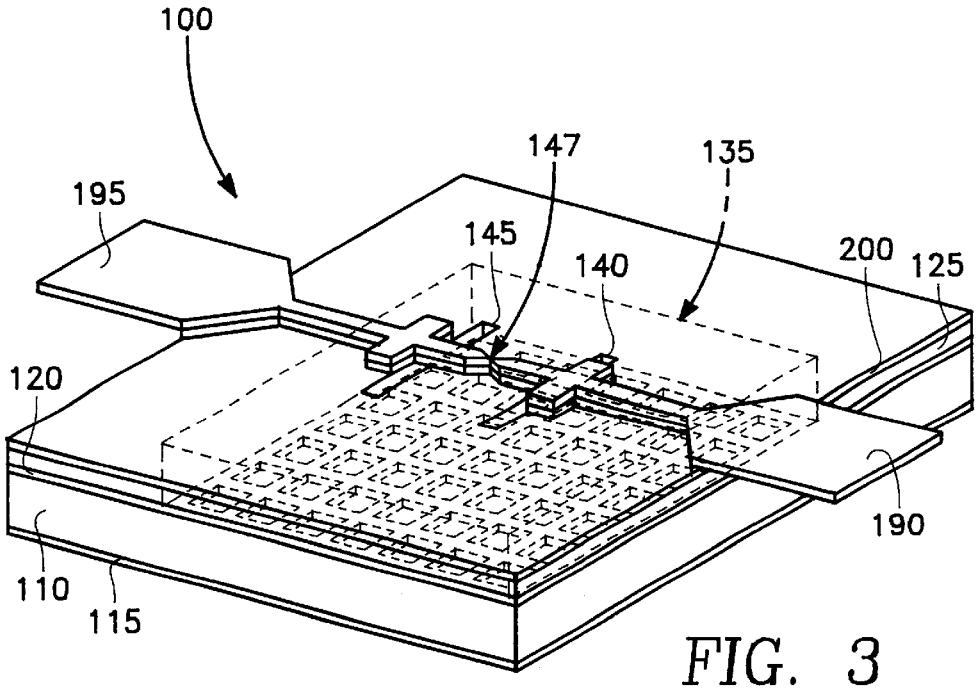
FIG. 3 is a transparent view corresponding to FIG. 1.

Referring now to FIGS. 1, 2, 3 and 4, an integrated circuit 100 converts incident submillimeter wave radiation of a selected frequency to D.C. power. The integrated circuit 100 consists of a thin base layer 110 formed from a wafer such as a silicon wafer. The thickness of the base layer 110 may be about one quarter wavelength of the incident radiation, or about 30 micrometers (microns) if the submillimeter wave radiation frequency is 2500 GHz. Such a 30 micron base layer 110 may be formed by chemical mechanical polishing of a conventional silicon wafer to the desired thickness, for example. A metallic thin film layer such as gold 115 is formed on the bottom face of the base layer 110 and an etch stop layer 120 is formed on the top face of the base layer. The composition of the etch stop layer 120 depends upon the etchant employed to etch the base layer 110 as will be described below, and may be, for example, silicon nitride. A thin membrane 125 is formed over the etch stop layer 120, the membrane 125 being about 2 or 3 microns thick and being of either silicon or gallium arsenide.

A first etchant that is selective to gold is employed to etch a mesh pattern in the bottom gold layer 115 consisting of an array of small openings 115*a*. The length and width of each of small openings may be about one tenth of the incident radiation wavelength, or about 12 microns. A second etchant selective to silicon is employed to flow through the openings 115*a* and etch out the interior of the silicon base layer 110 to form a hollow rectangular cavity 135 inside the base layer 110, the cavity 135 being shown in FIGS. 3 and 4. The cavity 135 may be slightly in excess of one wavelength in length and width, or about 140 microns. The etch stop layer 120 fixes the depth of this etch step, and thereby determines the depth of the cavity 135. Preferably, this depth is about a quarter wavelength, or about 30 microns.

A slot antenna structure is formed by etching a pair of parallel slots 140, 145 through the gold layer 200 and through the silicon membrane 125. The slots 140, 145 are each about a half wavelength in length and their center-to-center spacing is also about a half wavelength, or about 60 microns for a 2500 GHz radiation frequency. They are each about 8 microns in width.

Figure 5:
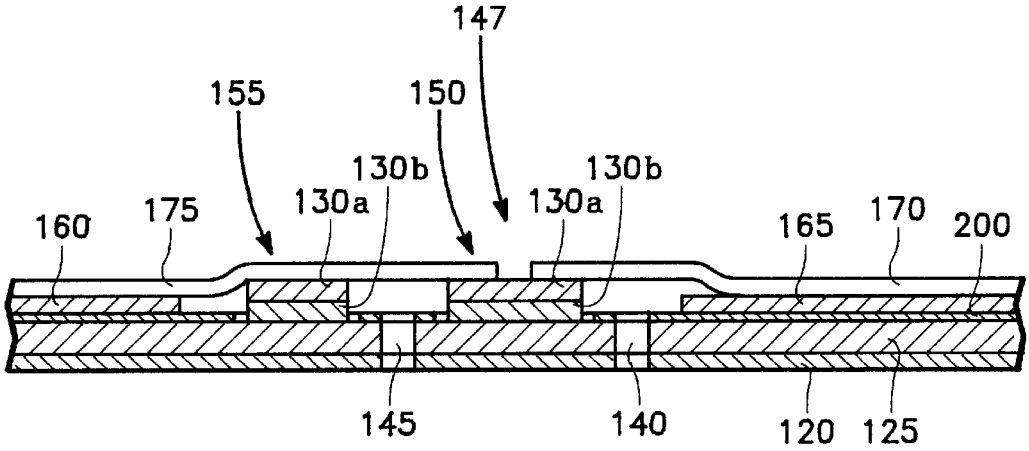
FIG. 5 is an enlarged cross-sectional side view of a portion of the integrated circuit of FIG. 1 showing the structure of a Schottky diode therein.
Figure 6:
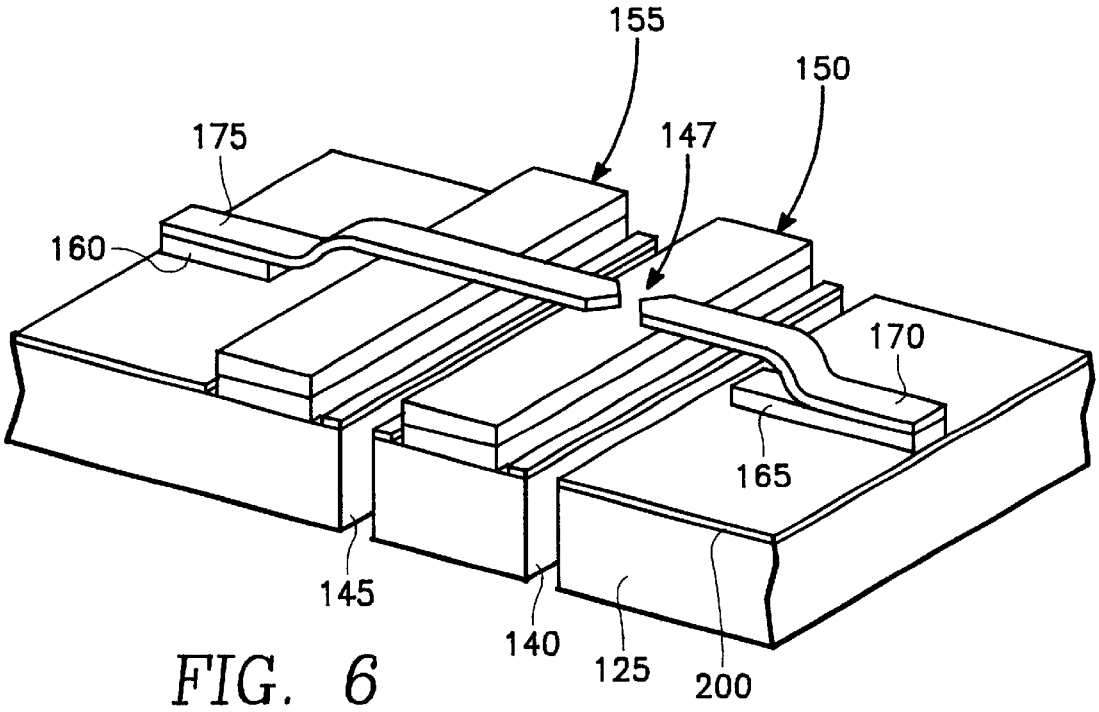
FIG. 6 is an enlarged perspective view of the Schottky diode of FIG. 5.
Figure 7:
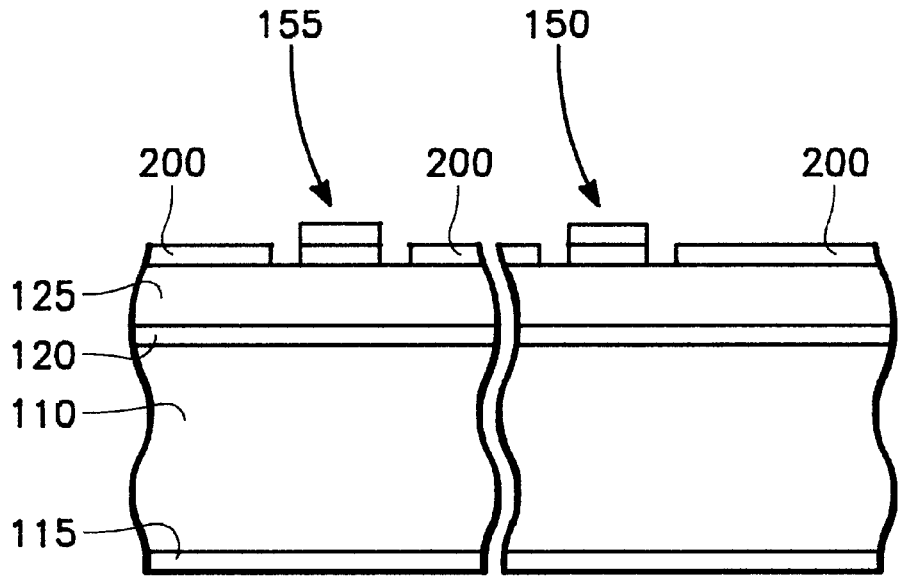
FIG. 7 is an enlargement of portions of FIG. 6 showing in greater detail the semiconductor structure.

FIGS. 1–4 indicate a Schottky diode generally at 147, the structure of this diode being too small for convenient illustration in these figures. The structure of the Schottky diode 147 is illustrated in detail in the exploded views of FIGS. 5–7. In order to form the diode 147, a very small window (too small to be seen in FIGS. 1–4 but visible in FIGS. 5–7)) is formed in the gold layer 200 in the region of the diode 147 in order to expose the top surface of the mesa 125 in this small region. A gallium arsenide (GaAs) active semiconductor layer 130 is formed over the small portion of the membrane 125 that has been thus exposed. Preferably, the GaAs layer consists of a bottom highly doped n-type (n+) layer 130*b* and a top lightly doped n-type (n) layer 130*a*. Referring to FIGS. 5, 6 and 7, the GaAs layer 130 is etched to form a GaAs mesa 150 and, if desired, an optional second GaAs mesa 155.

An insulating (e.g. silicon dioxide) layer is formed over the entire structure and then etched to define elongate insulating mesas 160, 165. A conductor (gold) layer is deposited and then etched to define a first elongate conductor 175 on the elongate insulating mesa 160 and bridging between the insulating mesa 160, the GaAs mesa 155 and the GaAs mesa 150, and a second elongate conductor 170 on the other elongate insulating mesa 165 bridging between the insulating mesa 165 and the GaAs mesa 150. The elongate gold conductors 170, 175 and the underlying elongate insulating mesas 160, 165 are generally congruent so that the gold conductors 170, 175 are everywhere insulated from the underlying gold layer 200. The Schottky diode 147 is formed at the contacts made by the two conductors 170, 175 to the top surface of the GaAs mesa 150.

The overall configuration of the two conductors 170, 175 is visible in FIG. 1, showing conductors 170, 175 extending away from the Schottky diode 147 and over respective ones of the slots 140, 145, and forming respective tuning capacitors 180, 185 adjacent respective slots 140, 145. The dielectric of the tuning capacitors 180, 185 is the silicon dioxide layer forming the insulating mesas 160, 165. The conductors 170, 175 are terminated in respective pads 190, 195 that are the external connectors of the integrated circuit 100 and supply D.C. electrical power to a component connected across the pads 190, 195 such as a microrobot, for example.

The conductors 170, 175 effectively divide the respective slots 140, 145 into two halves in the manner of a dipole, forming the slot antenna pattern in the gold layer 200 equivalent to a dipole antenna. The insulating (silicon dioxide) mesas 160, 165 electrically separate the gold conductors 170, 175 from the gold film 200 in the manner indicated in FIG. 6. Moreover, as shown in FIG. 7, the gold film 200 is terminated away from the GaAs mesa 150 so as to not interfere with the Schottky diode 147 (the conductors 170, 175 and the insulating layers 160, 165, are omitted from the partial view of FIG. 7 for the sake of clarity).

The pair of capacitors 180, 185 shown in FIG. 1 are sized to provide an optimum antenna impedance match. The quarter wavelength thick resonant cavity 135 in combination with the pair of dipole slots 140, 145 form a highly directional beam antenna whose characteristics (e.g., gain, resonance, etc.) are governed by the cavity 135. A significant advantage of the cavity 135 is that the reactance of nearby structures to which the integrated circuit 100 may be attached (such as various microrobots or bioengineering devices) do not affect antenna performance. Therefore, the integrated circuit 100 may be mounted on any device to which D.C. electrical power is to be supplied. One advantage of the selected submillimeter wave frequency (about 2500 GHz) is that radiation emanating at that frequency from a remote source toward the integrated circuit 100 is capable of penetrating various materials such as plastic, skin or flesh and the like. Thus, the integrated circuit and the microdevice to which it is attached may be buried under a layer of material or under the skin (for bioengineering applications). Another advantage that will be explored in greater detail below is that the antenna has a nearly purely resistive impedance that matches the impedance of the Schottky diode at this frequency. Also, since the selected frequency is clearly below optical frequencies, a RF antenna such as the one disclosed herein may be employed rather than an optically responsive diode. The advantage is that the antenna may be tuned (by selecting the tuning capacitors 180, 185) across a range of frequencies whereas an optical detecting diode must be designed with a bandgap matching the radiation frequency and therefore cannot be readily tuned.

Figure 8:
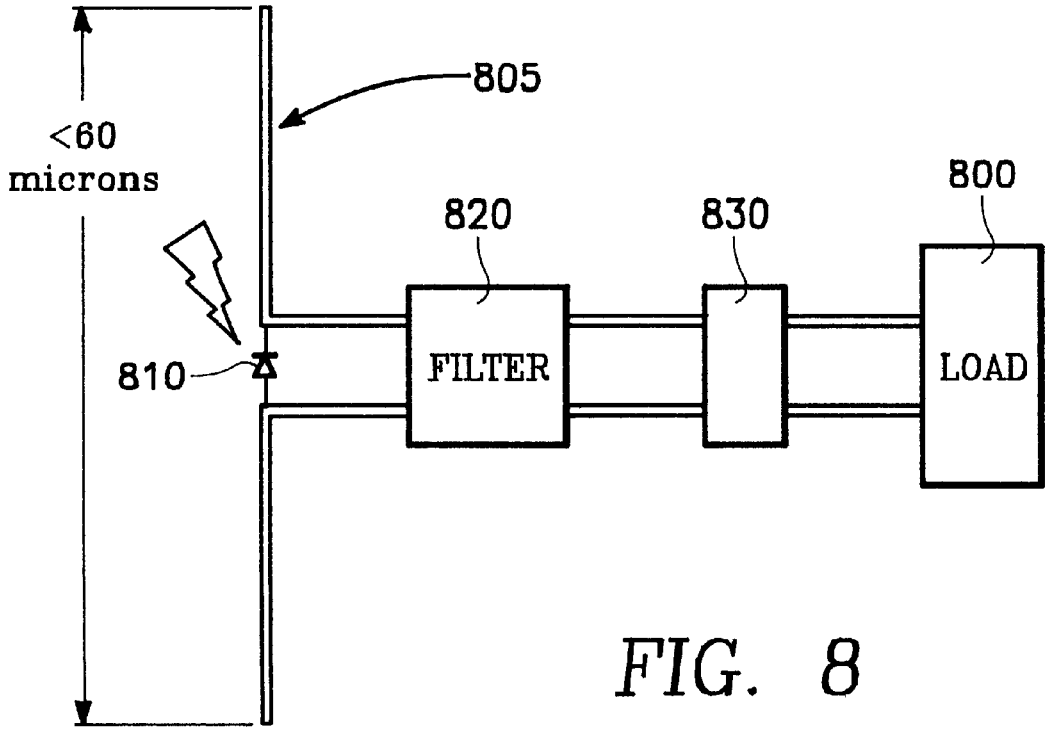
FIG. 8 is an electrical block diagram of an equivalent circuit corresponding to the apparatus of FIG. 1.

FIG. 8 is a block diagram of the integrated circuit 100 connected to supply D.C. electrical power to a load 800 such as a microrobot. The dipole antenna 805 consists of the pair of slot dipole antennas 140, 145 and the resonant cavity 135 of FIG. 1. The diode 810 is the diode 147 of FIG. 1. The filter 820 is the pair of filter capacitors 180, 185 of FIG. 1. The connecting pad 830 is the pair of conductive pads 190, 195 of FIG. 1.

Figure 4:
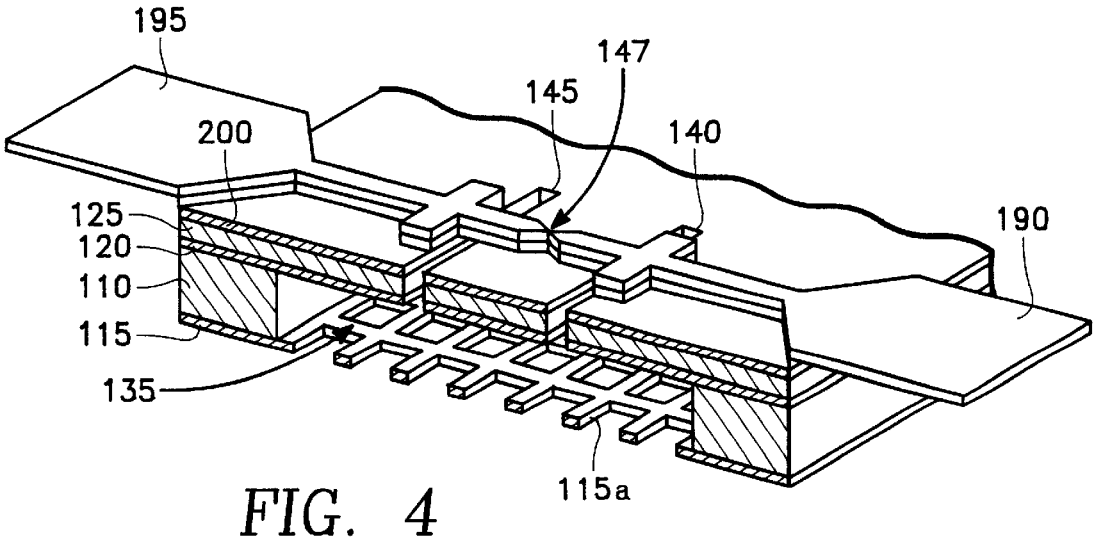
FIG. 4 is a partially cut-away perspective view corresponding to FIG. 3.
Figure 9:
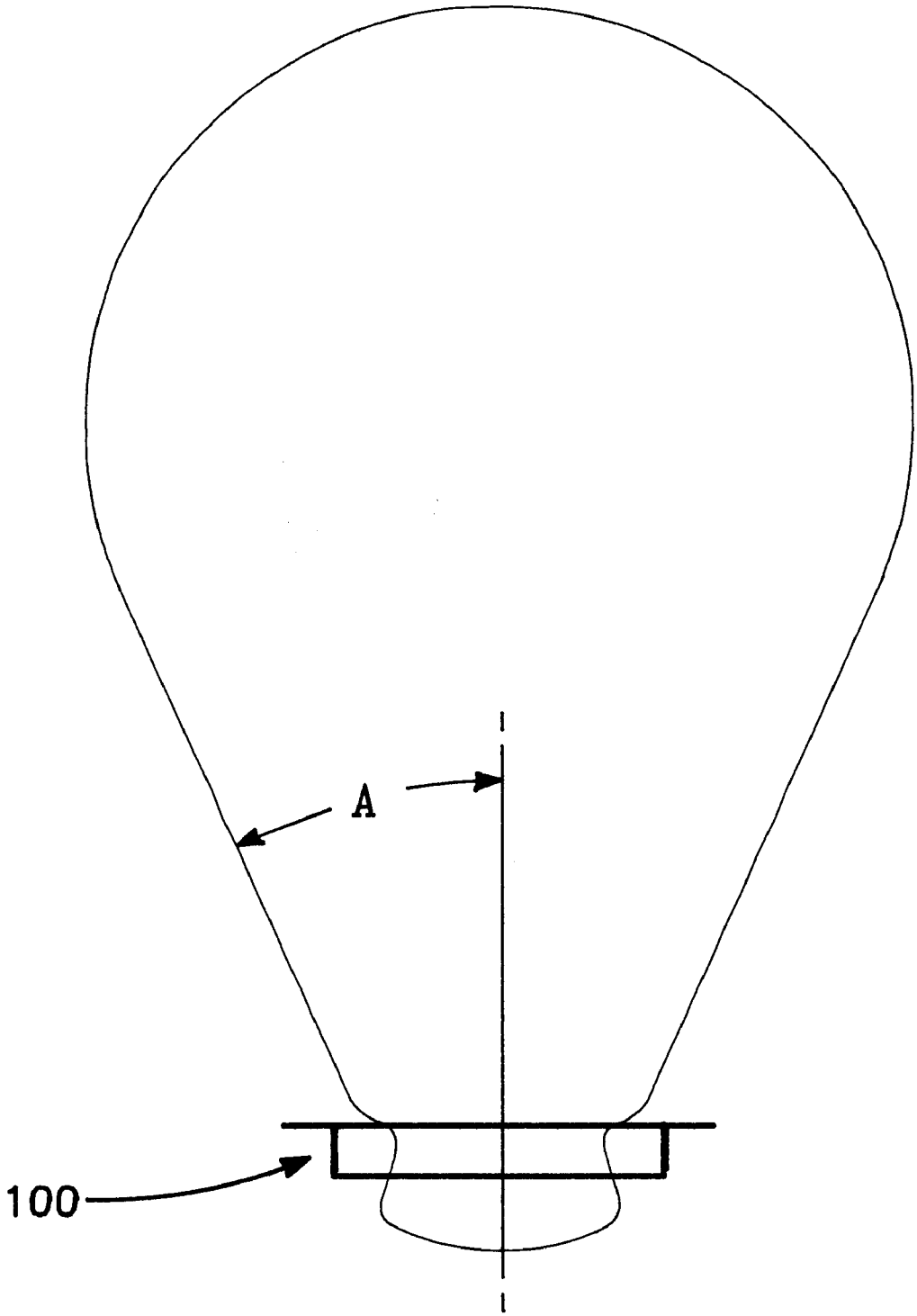
FIG. 9 is a diagram illustrating a side view of a 3-dimensional antenna power distribution pattern of the antenna of the apparatus of FIG. 1.
Figure 10:
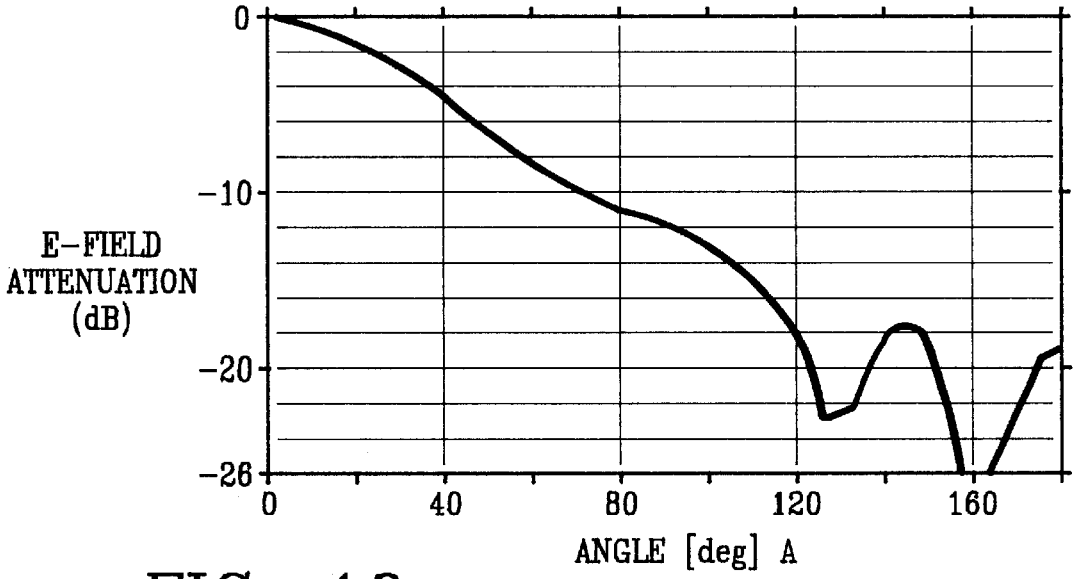
FIG. 10 is a graph showing the predicted electric field angular distribution of the antenna of the apparatus of FIG. 1.
Figure 11:
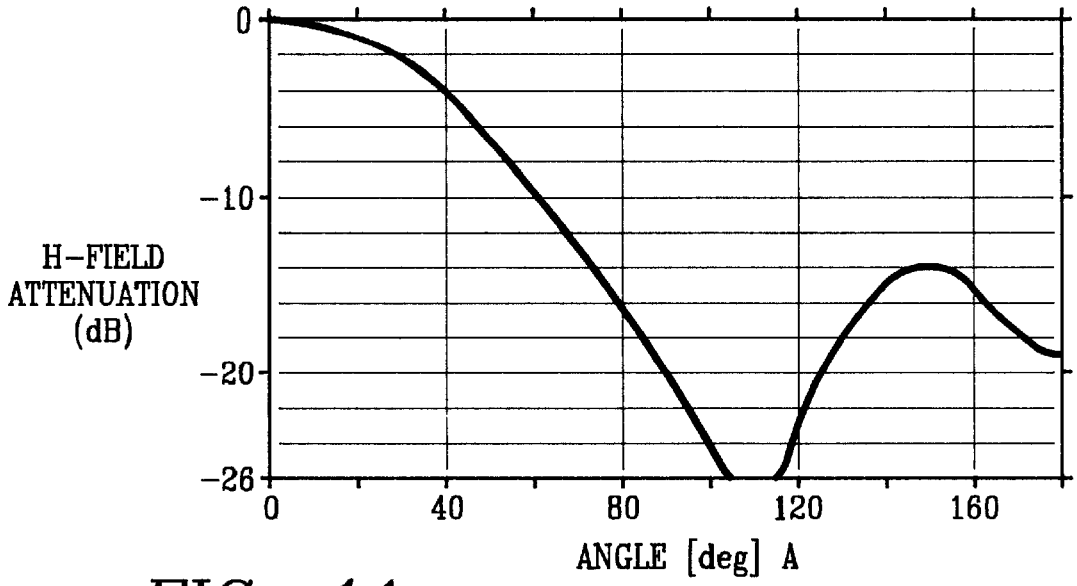
FIG. 11 is a graph showing the predicted magnetic field angular distribution of the antenna of the apparatus of FIG. 1.

FIG. 9 illustrates one plane of the 3-dimensional spatial distribution of the gain of the slot antenna structure 135, 140, 145 of FIG. 4. The relative gain is plotted as the length of a vector extending from the origin to the curve as a function of angle of incidence A. The plot of FIG. 9 shows that there is a very large forward-to-back gain ratio (in excess of 6 dB or more) and a narrow beam width in the forward direction (65 degrees at 3 dB). The narrow beam width is confirmed by the plots of E-field and H-field attenuation as a function of the angle A of FIGS. 10 and 11 respectively.

Figure 12:
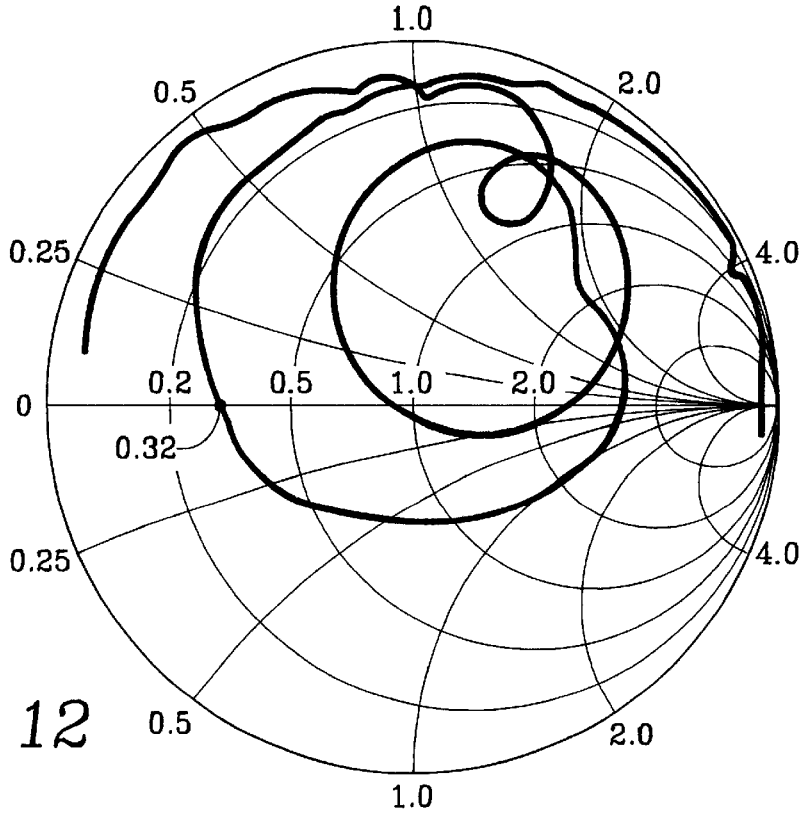
FIG. 12 is a Smith chart of the antenna of the apparatus of FIG. 1, showing the occurrence of a nearly purely resistive impedance of the antenna at a selected frequency (2445 GHz) that nearly matches the impedance of the Schottky diode at the same frequency.

FIG. 12 is a Smith chart of the impedance of the slot antenna structure 135, 140, 145 FIG. 4 for impedances normalized to 50 Ohms. FIG. 12 indicates that at a frequency of 2445 GHz the impedance is almost purely resistive at a normalize value of 0.32, which is 16 Ohms. This is the impedance of the Schottky diode 147 at 2445 GHz, so that a nearly perfect impedance match is provided for optimum power transfer efficiency.

Figure 13:
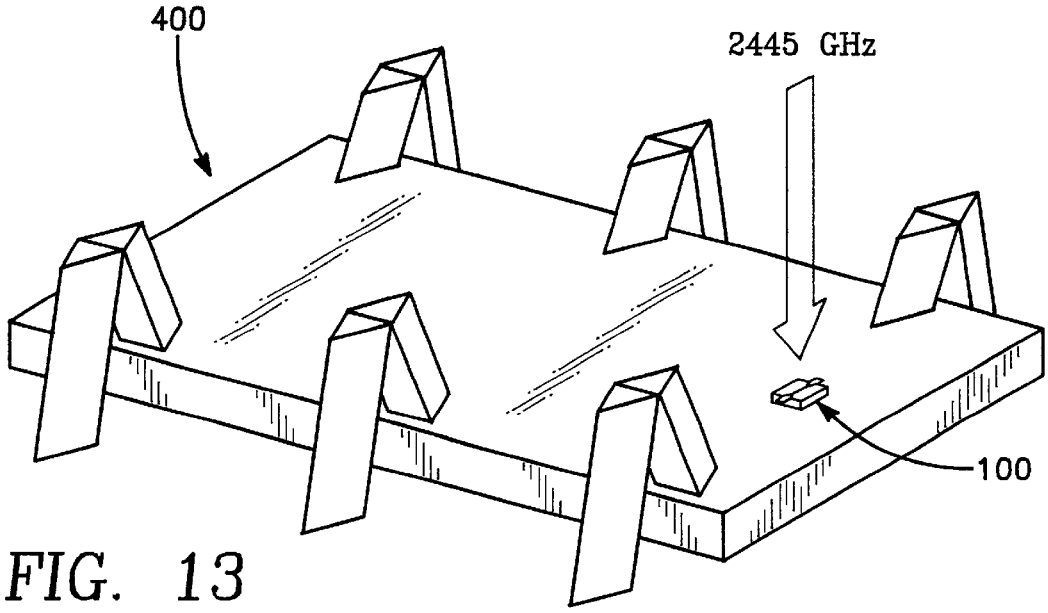
FIG. 13 illustrates the mounting of the apparatus of FIG. 1 on a known microrobot.

FIG. 13 illustrates the integrated circuit 100 mounted on a microrobot 400 with 2445 GHz radiation (from a laser for example) illuminating the integrated circuit 100.

Figure 14:
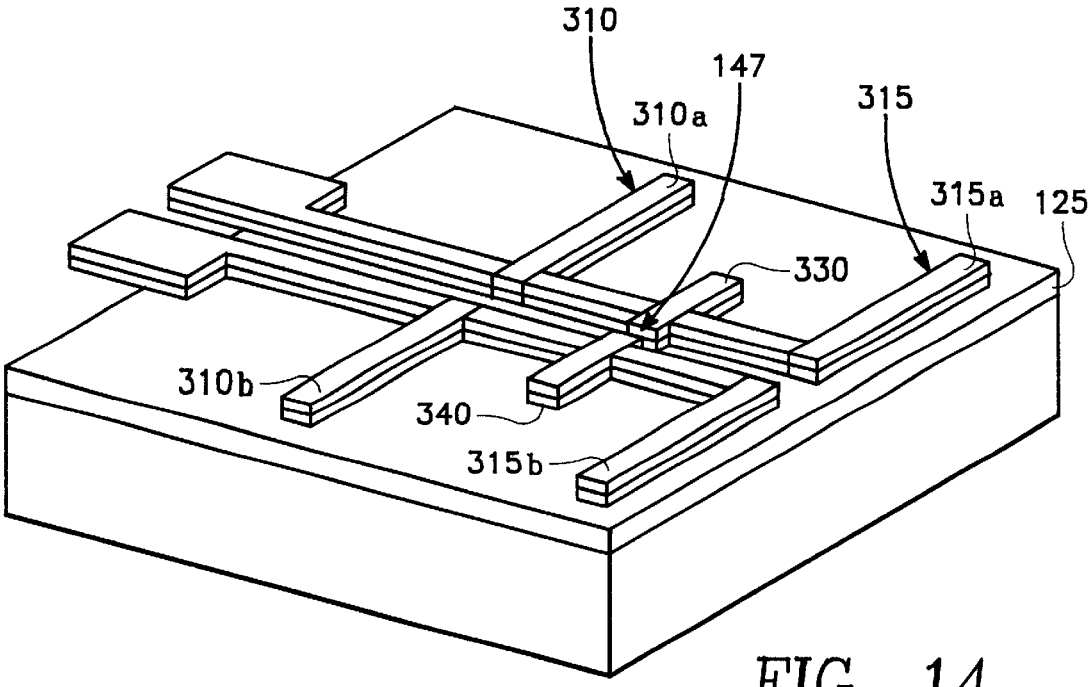
FIG. 14 illustrates how the slot antenna of FIG. 1 may be replaced by an equivalent conductor antenna.

FIG. 14 illustrates how the pair of dipole slot antennas 140, 145 may be replaced by an equivalent pair of conductor dipole antennas 310, 315. The gold film 200 covering the exposed top of the membrane 125 is eliminated and the dipole antennas are formed integrally with the gold conductors 170, 175 in the pattern illustrated in FIG. 14. The length of each dipole antenna 310, 315 is one half wavelength. Each dipole antenna 310, 315 is divided into two sections (310*a*, 310*b* and 315*a*, 315*b*), the diode 147 being connected across the two sections of each dipole 310, 315. The center-to-center spacing between the two dipole antennas 310, 315 is a half wavelength. A pair of tuning capacitors 330, 340 connected to opposite sides of the diode 147 may be formed in the gold conductor pattern as shown in FIG. 14.

Figure 15:
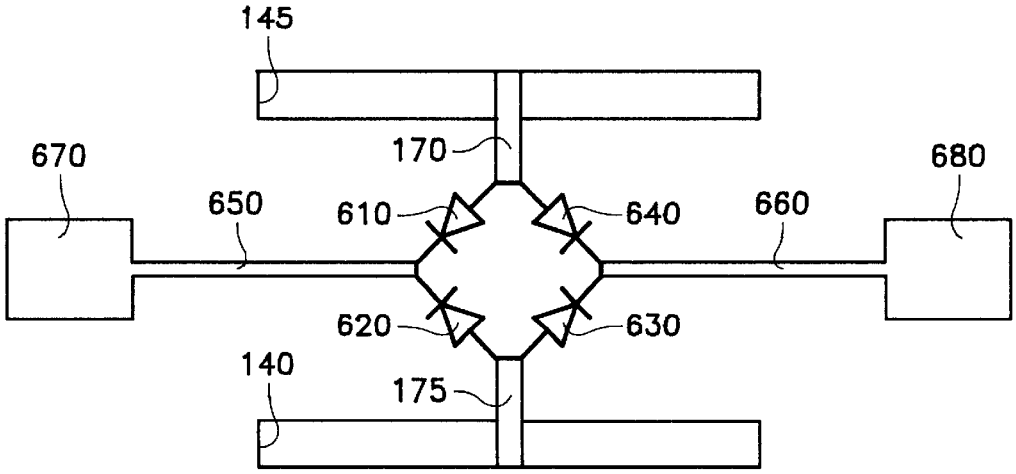
FIG. 15 illustrates a modification of the embodiment of FIG. 1 in which the single rectifying diode is replaced by a full-wave diode rectifying bridge.

FIG. 15 illustrates how a full wave rectifier bridge of four matched Schottky diodes 610, 620, 630, 640 may replace the single Schottky diode 147 of FIG. 1. In FIG. 15, the conductors 170, 175 each extend only from the far side of a respective slot 145, 140 to a corresponding terminal pair of the rectifier bridge, while a pair of output conductor 650, 660 extend from the remaining terminal pair of the rectifier bridge to output pads 670, 680.

While the antenna length of the preferred embodiment is a half wavelength, other suitable lengths may be employed such as multiples of ⅛ (e.g., ⅝ wavelength). Moreover, while the cavity length and width have been described as being preferably about one wavelength, they may be multiples of one wavelength. Moreover, the cavity thickness, while having been described as being preferably one quarter wavelength, may be odd multiples of one quarter wavelength. However, it should be noted that it is felt the performance described herein is expected to be most readily attained in the preferred embodiment.

While the invention has been described in detail with reference to preferred embodiments, it is understood that variations and modifications thereof may be made without departing from the true spirit and scope of the invention.

What is claimed is:

1. A submillimeter wave antenna and rectifier integrated circuit for mounting on and supplying D.C. electrical power to a microminiature device, said integrated circuit comprising:

an underlying cavity of semiconductor material having a length and width corresponding to a selected submillimeter wavelength and a thickness corresponding to one quarter of said selected wavelength, said cavity having side walls and a planar conductive floor;

a planar membrane of semiconductive material constituting a ceiling of said cavity and being parallel to said planar floor;

an antenna structure on said planar membrane, said antenna structure comprising antenna elements each having a length corresponding to a predetermined fraction of said selected submillimeter wavelength;

a semiconductor rectifier formed on said membrane and connected across said antenna structure.

2. The integrated circuit of claim 1 wherein said antenna structure comprises plural parallel spaced apart dipole antennas each of a length of half of said selected wavelength and each separated into two sections.

3. The integrated circuit of claim 2 wherein said dipole antennas comprise two elongate slot antennas and said rectifier is connected between said two elongate slot antennas comprising respective slots formed through said membrane.

4. The integrated circuit of claim 2 wherein said dipole antennas comprise two conductor antennas and said rectifier is connected between the two sections of each of said dipole antennas.

5. The integrated circuit of claim 3 further comprising a pair of conductors formed as a conductive thin film layer overlying said membrane and connected to opposite sides of said rectifier, each of said pair of conductors having a respective elongate portion extending transversely across a respective one of said elongate slots whereby to divide the one slot into two equal slot sections to define corresponding dipole elements.

6. The integrated circuit of claim 5 wherein said rectifier comprises a diode.

7. The integrated circuit of claim 6 wherein said rectifier comprises a one half or full-wave rectifying diode bridge.

8. The integrated circuit of claim 6 wherein said diode comprises a GaAs layer on said membrane and a pair of contacts an a top surface of said GaAs layer to respective ones of said pair of conductors.

9. The integrated circuit of claim 1 wherein said conductive floor comprises a metallic planar film having an array of voids formed therethrough, each of said voids having an area sufficiently large to permit liquid etchant flow therethrough and sufficiently small to have negligible effect at said selected wavelength.

10. The integrated circuit of claim 9 further comprising an etch stop layer between a base layer and said membrane.

11. The integrated circuit of claim 5 further comprising a conductive cover layer overlying portions of said membrane not covered by said pair of conductors, said conductive cover layer being electrically separate from said pair of conductors, said elongate slots forming corresponding voids in said conductive cover layer.

12. The integrated circuit of claim 1 wherein said selected submillimeter wavelength is about 120 microns.

13. The integrated circuit of claim 12 wherein said rectifier comprises a Schottky diode mesa structure of less than about ten microns in length and width.

14. The integrated circuit of claim 1 wherein said rectifier comprises a Schottky diode mesa structure and said selected wavelength corresponds to a frequency at which said antenna structure has an impedance at least nearly matching an impedance of said Schottky diode at the same frequency.

15. The integrated circuit of claim 5 further comprising an insulating thin film layer between conductor thin film layer and said membrane and a pair of capacitors connected to respective ones of said pair of conductors formed in said conductive thin film layer and separated from said membrane by said insulating thin film layer.

16. The integrated circuit of claim 15 wherein said pair of capacitors comprise tuning capacitors.

17. The integrated circuit of claim 1 wherein the semiconductor material of a base layer and the semiconductor material of said membrane are each intrinsic semiconductor material.

18. The integrated circuit of claim 17 wherein said rectifier comprises doped semiconductor material comprising a lower n+ layer of GaAs and an upper n layer of GaAs and a pair of metal contacts on a top surface of said n layer constituting opposite terminals of said rectifier.

19. A submillimeter wave antenna and rectifier integrated circuit for mounting on and supplying D.C. electrical power to a microminiature device, said integrated circuit comprising:

an underlying cavity of semiconductor material having a length and width lying in a plane and corresponding to a selected submillimeter wavelength and having a thickness normal to said plane, said cavity having side walls and a planar conductive floor parallel to said plane;

a planar membrane of semiconductive material constituting a ceiling of said cavity and being parallel to said planar floor;

an antenna structure on said planar membrane, said antenna structure comprising antenna elements each having a length corresponding to a predetermined fraction of said selected submillimeter wavelength, said thickness of said cavity being related to said selected submillimeter wavelength in such a manner that said cavity produces in said antenna structure a front-to-back antenna gain ratio in a direction normal to said plane of at least 6 dB;

a semiconductor rectifier formed on said membrane and connected across said antenna structure.

20. The integrated circuit of claim 19 wherein said antenna structure comprises plural parallel spaced apart dipole antennas each of a length of half of said selected wavelength and each separated into two sections.

21. The integrated circuit of claim 20 wherein said dipole antennas comprise two elongate slot antennas and said rectifier is connected between said two elongate slot antennas comprising respective slots formed through said membrane.

22. The integrated circuit of claim 20 wherein said dipole antennas comprise two conductor antennas and said rectifier is connected between the two sections of each of said dipole antennas.

23. The integrated circuit of claim 21 further comprising a pair of conductors formed as a conductive thin film layer overlying said membrane and connected to opposite sides of said rectifier, each of said pair of conductors having a respective elongate portion extending transversely across a respective one of said elongate slots whereby to divide the one slot into two equal slot sections to define corresponding dipole elements.

24. The integrated circuit of claim 23 wherein said rectifier comprises a diode.

25. The integrated circuit of claim 24 wherein said rectifier comprises a full-wave rectifying diode bridge.

26. The integrated circuit of claim 24 wherein said diode comprises a GaAs layer on said membrane and a pair of contacts on a top surface of said GaAs layer to respective ones of said pair of conductors.

27. The integrated circuit of claim 19 wherein said conductive floor comprises a metallic planar film having an array of voids formed therethrough, each of said voids having an area sufficiently large to permit liquid etchant flow therethrough and sufficiently small to have negligible effect at said selected wavelength.

28. The integrated circuit of claim 27 further comprising an etch stop layer between a base layer and said membrane.

29. The integrated circuit of claim 23 further comprising a conductive cover layer overlying portions of said membrane not covered by said pair of conductors, said conductive cover layer being electrically separate from said pair of conductors, said elongate slot forming corresponding voids in said conductive cover layer.

30. The integrated circuit of claim 19 wherein said selected submillimeter wavelength is about 120 microns.

31. The integrated circuit of claim 30 wherein said rectifier comprises a Schottky diode mesa structure of less than about ten microns in length and width.

32. The integrated circuit of claim 19 wherein said rectifier comprises a Schottky diode mesa structure and said selected wavelength corresponds to a frequency at which said antenna structure has an impedance at least nearly matching an impedance of said Schottky diode at the same frequency.

33. The integrated circuit of claim 23 further comprising an insulating thin film layer between conductor thin film layer and said membrane and a pair of capacitors connected to respective ones of said pair of conductors formed in said conductive thin film layer and separated from said membrane by said insulating thin film layer.

34. The integrated circuit of claim 33 wherein said pair of capacitors comprise tuning capacitors.

35. The integrated circuit of claim 19 wherein the semiconductor material of a base layer and the semiconductor material of said membrane are each intrinsic semiconductor material.

36. The integrated circuit of claim 35 wherein said rectifier comprises doped semiconductor material comprising a lower n+ layer of GaAs and an upper n layer of GaAs and a pair of metal contacts on a top surface of said n layer constituting opposite terminals of said rectifier.

37. The integrated circuit of claim 19 wherein said antenna structure has a 3 dB beamwidth of about 65 degrees.

* * * * *